US006554628B2

(12) United States Patent
Aleshevich et al.

(10) Patent No.: US 6,554,628 B2
(45) **Date of Patent: *Apr. 29, 2003**

(54) REMOTE CABLE EXTRACTOR

(75) Inventors: Edward Joseph Aleshevich, Waynesboro, VA (US); Charles Maddox, Barboursville, VA (US); Jeffry Alan Tillery, Radiant, VA (US)

(73) Assignee: General Electric Co., Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/368,771

(22) Filed: Aug. 5, 1999

(65) Prior Publication Data

US 2001/0051463 A1 Dec. 13, 2001

(51) Int. Cl.[7] ..... H01R 13/62

(52) U.S. Cl. ..... 439/160; 439/157; 439/153; 439/372

(58) Field of Search ..... 439/160, 157, 439/153, 372

(56) References Cited

U.S. PATENT DOCUMENTS

| | | | | | |
|---|---|---|---|---|---|
| 2,430,011 | A | * | 11/1947 | Gillentine | 439/160 |
| 3,526,868 | A | * | 9/1970 | Mattson et al. | 439/160 |
| 4,447,101 | A | | 5/1984 | Gugliotti | 439/157 |
| 4,898,540 | A | * | 2/1990 | Saito | 439/153 |
| 5,257,942 | A | | 11/1993 | Taguchi | 439/157 |
| 5,380,213 | A | * | 1/1995 | Piorunneck et al. | 439/160 |
| 5,484,297 | A | * | 1/1996 | Takahashi et al. | 439/157 |
| 5,575,671 | A | | 11/1996 | Katsuma | 439/157 |
| 6,095,833 | A | * | 8/2000 | Osawa | 439/157 |

FOREIGN PATENT DOCUMENTS

| | | | | |
|---|---|---|---|---|
| DE | 0137782 | * | 9/1979 | 439/160 |
| GB | 2085671 | * | 4/1982 | 439/160 |

* cited by examiner

*Primary Examiner*—Tho D. Ta
(74) *Attorney, Agent, or Firm*—Karl A. Vick; Armstrong Teasdale

(57) ABSTRACT

An extractor rotatably couples to a connector and includes an extractor body, a first member, a second member, a biasing mechanism, and a cam arm. The first member and the second member both extend perpendicularly away from the extractor body to engage the connector. The cam arm attaches to the extractor body and extends perpendicularly away from the extractor body. A biasing mechanism is attached to the extractor which biases the cam arm. As the cam arm is rotated, the first and second members contact the connector and separate the connector assembly from the electrical device.

19 Claims, 3 Drawing Sheets

REMOTE CABLE EXTRACTOR

BACKGROUND OF THE INVENTION

This invention relates generally to connector assemblies and, more particularly, to an extractor for separating a connector assembly from an electrical device.

As technology has advanced in electrical systems, the complexity and amount of electrical connections between electrical connectors and electrical devices has increased. Typically the electrical connectors and the electrical devices are electrically connected with a plurality of electrical pins which are frictionally inserted into electrical contacts located within receiving apertures.

Usually, electrical connectors include a connector assembly which includes a connector mechanism which receives a cable and also includes a facing surface which includes a plurality of apertures which receive electrical pins, or a plurality of electrical pins which electrically connect within a plurality of apertures. The electrical device typically includes a mating facing surface which includes either a plurality of electrical pins to insert in the apertures of the electrical connector, or a plurality of apertures to receive the electrical pins from an electrical connector. In either electrical connection scheme, a large amount of force is often necessary to separate the electrical device from the electrical connector. Exerting such a large amount of force can cause the connection assembly to inadvertently become twisted or damaged during the separation. Any amount of twisting between the electrical device and the electrical connection may damage the electrical pins, the electrical connector assembly, or the electrical device.

Accordingly, it would be desirable to provide an extractor device which can be integrally constructed with a connector assembly, or can be installed on current connector assemblies, and would permit the connector assembly to be easily separated from the electrical device without requiring the large amount of force that must be exerted with known connector assemblies.

SUMMARY OF THE INVENTION

In an exemplary embodiment of the invention, an extractor installs easily to a connector assembly and provides an easy means of separating the connector assembly from an electrically connected electrical device.

The extractor, which attaches to a connector, includes an extractor body, a first member, a second member, a biasing mechanism, and a cam arm. The first member and the second member are positioned parallel to each other and both extend substantially perpendicularly away from the extractor body to engage the connector. The first member has a first end attached to the extractor body, a second end which extends angularly away from the first end, and a receptacle positioned between the first and second ends. The second member is constructed similarly. The cam arm attaches to the extractor body and extends perpendicularly away from the extractor body.

The extractor is rotatably coupled to the connector which includes a pair of hinge pins which insert and extend through the receptacles located on the extractor. The cam arm is movable from a first position to a second position. Any movement of the cam arm causes a simultaneous movement of the extractor. A biasing mechanism is attached which includes a spring disposed between the connector and the cam arm. The spring biases the cam arm such that the cam arm remains in the first position and when the cam arm is rotated to the second position, the spring causes the cam arm to return to the first position when it is physically released.

To separate a connector from an electrical device, the cam arm is rotated from the first position to the second position. The rotation causes a compression of the spring and a simultaneous rotation of the extractor including the first and second members. As the first and second members are rotated, the second end of each respective member contacts the electrical device and separates the connector assembly from the electrical device.

The extractor can be integrally constructed with connector assemblies or easily installed on existing connector assemblies. Such an extractor ensures that any amount of force necessary to separate the two components is directed in an appropriate direction and as a result, no twisting occurs between the components. As such, the risk of damage to either the connector assembly or the electrical device is minimized.

DETAILED DESCRIPTION OF THE INVENTION

Figure 1:
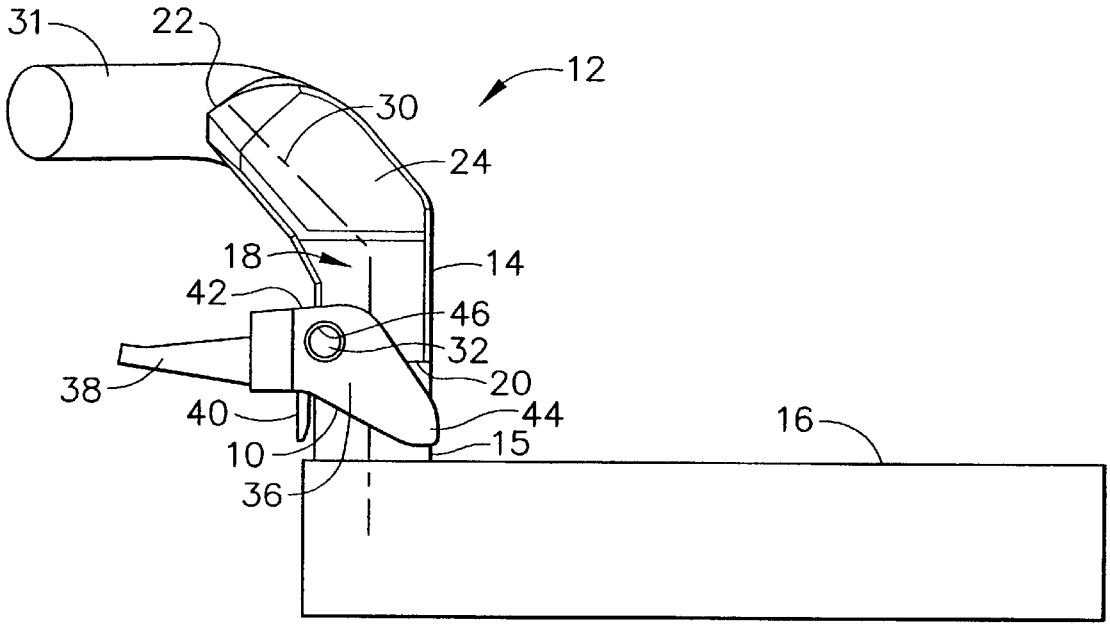
FIG. 1 is a side elevational view of an extractor attached to a connector assembly.

FIG. 1 is a side elevational view of an extractor 10 attached to a connector assembly 12 which includes a connector 14. Connector 14 is electrically connected to a mating connector 15 mounted on an electrical device 16 and includes a body 18 having a front surface 20 and a back surface 22. A first side wall 24 and a second side wall (not shown) are attached between front surface 20 and back surface 22. Additionally, a top surface (not shown in FIG. 1) and a bottom surface (not shown in FIG. 1) are also attached between front surface 20 and back surface 22. Body 18 also has an axis of symmetry 30 which extends from front surface 20 to back surface 22. A plurality of apertures (not shown in FIG. 1) extend through body 18 in a direction substantially parallel to axis of symmetry 30. Within the apertures are a plurality of electrical contacts (not shown in FIG. 1) which extend to a position adjacent back surface 22. Body 18 receives a cable 31 in back surface 22. Cable 31 includes a plurality of wires (not shown) to electrically connect to connector assembly 12.

First side wall 24 has a first hinge pin 32 and the second side wall has a second hinge pin (not shown). Extractor 10 is movably coupled to body 18 at first hinge pin 32 and the second hinge pin. Extractor 10 includes a body (not shown in FIG. 1), a first member 36, a second member (not shown in FIG. 1), a cam arm 38, and a cam stop 40. The extractor body extends between first member 36 and the second member. First member 36 extends substantially perpendicularly from the extractor body and includes a first end 42 attached to the extractor body and an offset second end 44 which extends from first end 42 in an acute angular direction. A first receptacle 46 is positioned between first end 42 and second end 44. First hinge pin 32 extends through receptacle 46 to rotatably couple extractor 10 to connector body 18. The second member extends substantially perpendicularly from the extractor body and includes a second end (not shown in FIG. 1) which is rotatably coupled to connector body 18. The second member is positioned substantially opposite first member 36.

Cam arm 38 is attached to the extractor body and extends substantially perpendicularly away from the extractor body. Cam stop 40 is attached to the extractor body and extends substantially co-planarly outward from the extractor body in a direction extending away from front surface 20. Cam stop 40 is described in more detail below.

Figure 2:
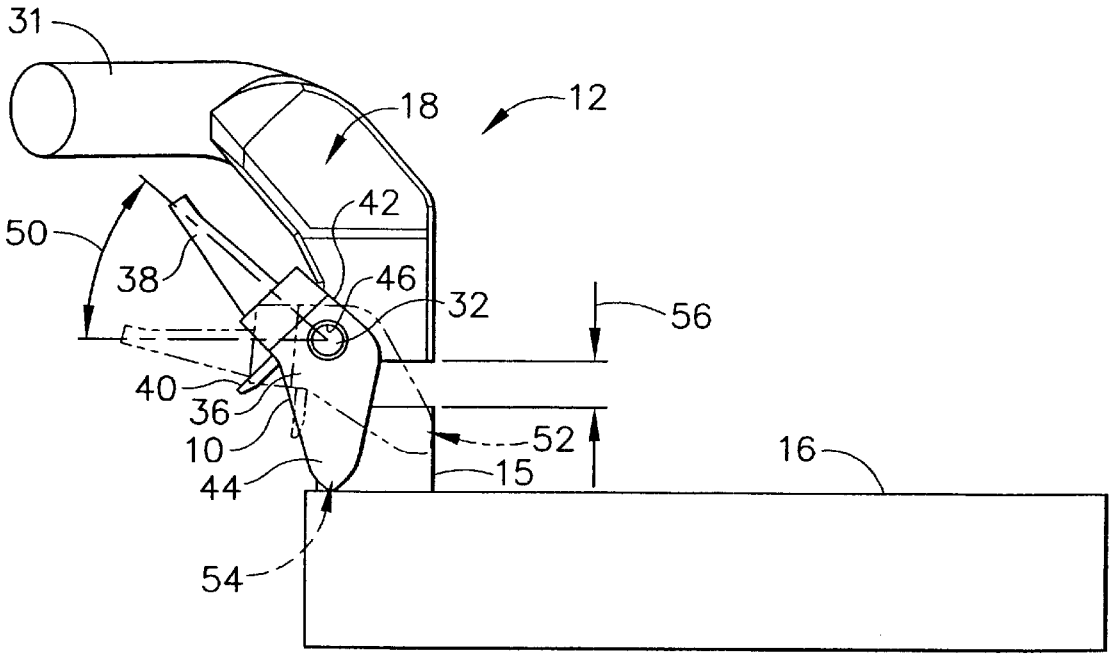
FIG. 2 is a side elevational view of the extractor shown in FIG. 1 in a second position.

FIG. 2 is a side elevational view of extractor 10 including connector assembly 12. Extractor 10 is rotatably coupled to connector body 18 and is movable through an angle 50 with respect to connector body 18 such that attached cam arm 38 rotates from a first position 52 to a second position 54. Cam stop 40 contacts electrical device 16 and prevents extractor 10 from over-rotating when cam arm 38 is returned to first position 52.

Connector 14 is capable of being electrically connected to electrical device 16, through mating connector 15, when cam arm 38 is in first position 52. When cam arm 38 is rotated through angle 50 around hinge pin 32 from position 52 towards position 54, first member 36 and the second member are rotated simultaneously with cam arm 38. When cam arm 38 is positioned at second position 54, second end 44 of first member 36 is rotated and contacts electrical device 16 forcing connector 14 apart from electrical device 16 and mating connector 15, a distance 56. The second end of the second member operates simultaneously in a similar manner with first member 36 when cam arm 38 is rotated. When cam arm 38 is released after separating connector 14 and electrical device 16, cam arm 38 is biased by a biasing mechanism (not shown) and returns to first position 52.

Figure 3:
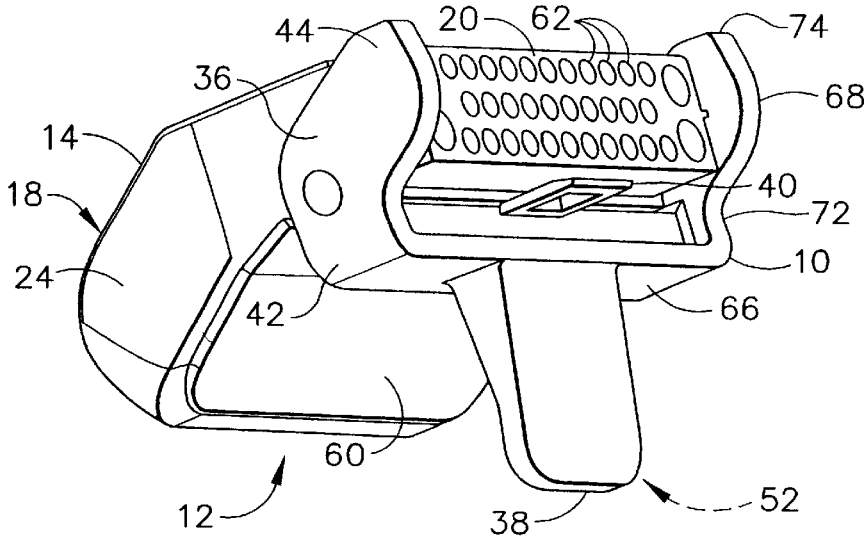
FIG. 3 is a perspective view of the extractor and connector assembly shown in FIG. 1.

FIG. 3 is a perspective view of extractor 10 including connector assembly 12. Connector 14 includes body 18 which has a front surface 20, a back surface (not shown in FIG. 3), a bottom surface 60, a top surface (not shown in FIG. 3), first side wall 24, and a second side wall (not shown). A plurality of apertures 62 extend rearwardly into front surface 20 of connector body 18. Apertures 62 permit the entry of electrical pins (not shown) from an electrical device, similar to electrical device 16 shown in FIG. 1, into connector body 18 to electrically connect to electrical contacts (not shown) within connector body 18.

Extractor 10 is rotatably coupled to connector 14 and includes an extractor body 66, first member 36, a second member 68, cam arm 38, and cam stop 40. Extractor body 66 extends between first member 36 and second member 68. First member 36 extends substantially perpendicularly from extractor body 66 and includes first end 42 and second end 44 which extends co-planarly outwardly away from first end 42 in an acute angular direction. Second member 68 extends substantially perpendicularly away from extractor body 18 and includes a first end 72 attached to extractor body 66 and a second end 74 which extends co-planarly outwardly away from first end 72 in an acute angular direction.

Cam stop 40 is attached to extractor body 66 and extends perpendicularly away from extractor body 66. Cam stop 40 is positioned substantially parallel to extractor body 66 and contacts the electrical device (not shown in FIG. 3) to prevent extractor 10 from over-rotating when cam arm 38 is released after being rotated to a second position (not shown in FIG. 3) and is returning to first position 52.

Figure 4:
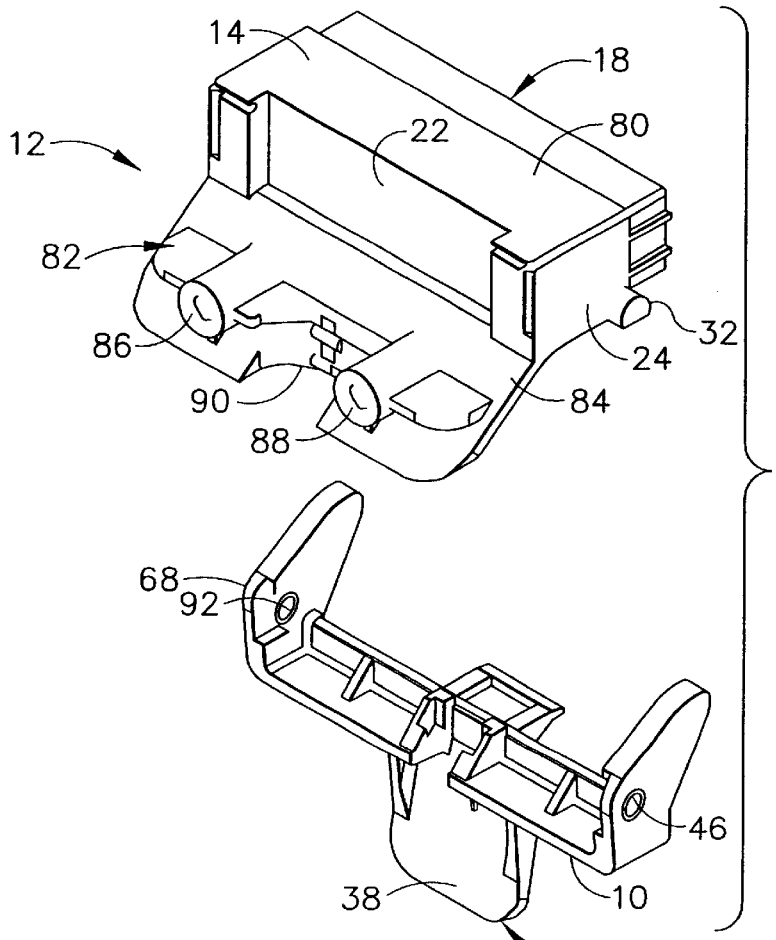
FIG. 4 is an exploded perspective view of the extractor and connector assembly shown in FIG. 1.

FIG. 4 is an exploded perspective view of connector assembly 12 and extractor 10. Connector 14 includes body 18 which includes back surface 22, first side wall 24, and a top surface 80. Additionally, connector 14 includes a second side wall (not shown), a bottom surface (not shown in FIG. 4), and a front surface (not shown in FIG. 4). Back surface 22 includes a cable connector assembly 82 which includes a removable cover 84. Cover 84 provides access to the apertures and electrical contacts, a pair of attachment points 86 and 88 which anchor cover 84 to connector body 18, and a notch 90 through which a cable (not shown in FIG. 4) is fed to electrically connect with connector assembly 12. Side wall 24 includes first hinge pin 32 which is inserted in first receptacle 46 to rotatably couple connector 14 to extractor 10. The second side wall has a similar hinge pin which is received in a second receptacle 92 located within second member 68 on extractor 10.

Figure 5:
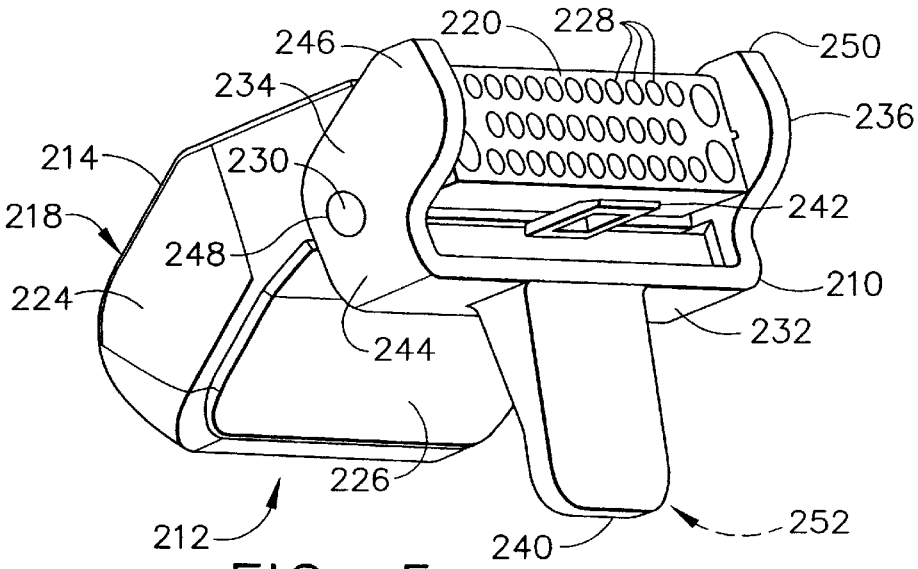
FIG. 5 is a perspective view of a second embodiment of an extractor attached to a connector assembly.

FIG. 5 is a perspective view of a second embodiment of an extractor 210 attached to a connector assembly 212 which includes a connector 214. Connector 214 is electrically connected to an electrical device (not shown) and includes a body 218 having a front surface 220 and a back surface (not shown in FIG. 5). A first side wall 224 and a second side wall (not shown) are attached between front surface 220 and the back surface. Additionally, a top surface (not shown in FIG. 5) and a bottom surface 226 are also attached between front surface 220 and the back surface. A plurality of apertures 228 extend through body 218. Within the apertures are a plurality of electrical contacts (not shown in FIG. 5) which extend to a position adjacent the back surface. Body218 receives a cable (not shown) in the back surface. The cable includes a plurality of wires (not shown) which electrically connect to connector assembly 212.

First side wall 224 has a first hinge pin 230 and the second side wall has a second hinge pin (not shown). Extractor 210 is movably coupled to body 218 at first hinge pin 230 and the second hinge pin. Extractor 210 includes a body 232, a first member 234, a second member 236, a cam arm 240, and a cam stop 242. Extractor body 232 extends between first member 234 and second member 236. First member 234 extends substantially perpendicularly from extractor body 232 and includes a first end 244 attached to extractor body 234 and an offset second end 246 which extends from first end 244 in an acute angular direction. A first receptacle 248 is positioned between first end 244 and second end 246. First hinge pin 230 extends through receptacle 248 to rotatably couple extractor 210 to connector body 218. Second member 236 extends substantially perpendicularly from extractor body 232 and includes a second end 250 which is rotatably coupled to connector body 218. Second member 236 is positioned substantially opposite first member 234.

Extractor 210 is rotatable between a first position 252 and a second position (not shown). Extractor 210 includes a biasing mechanism (not shown in FIG. 5) which biases cam arm 240 to remain in first position 252 and to return to first position 252 after being rotated to the second position. When cam arm 240 is rotated from first position 252 to the second position, first member 234 and second member 236 are rotate simultaneously with cam arm 240. As cam arm 240 is rotated to the second position, second end 246 of first member 234 is rotated and contacts the electrical device which forces connector 214 apart from the electrical device. Second end 250 of second member 236 operates simultaneously in a similar manner with first member 234 when cam arm 240 is rotated. When cam arm 240 is released after forcing connector 214 and the electrical device apart, the biasing mechanism returns cam arm 240 to first position 252.

Cam stop 242 is attached to extractor body 232 and extends perpendicularly away from extractor body 232. Cam stop 242 is positioned substantially parallel to extractor body 232 and contacts the electrical device which prevents extractor 210 from over-rotating when cam arm 240 is returned to first position 252.

Figure 6:
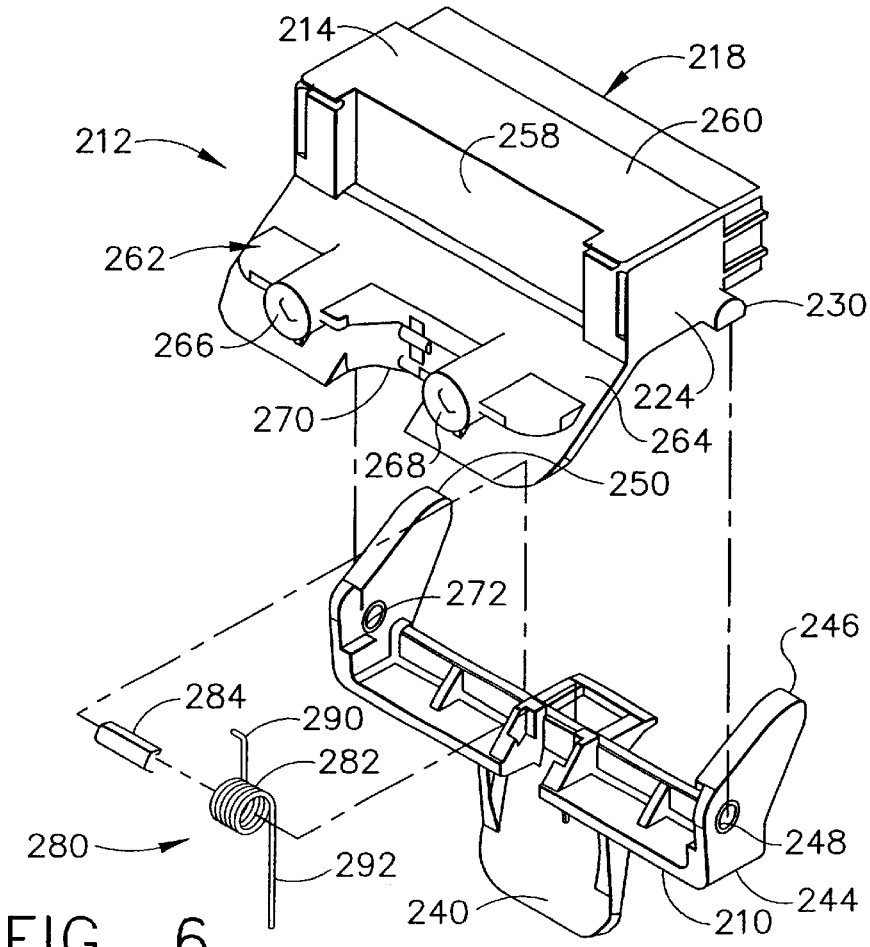
FIG. 6 is an exploded perspective view of the extractor and connector assembly shown in FIG. 5.

FIG. 6 is an exploded perspective view of connector assembly 212 and extractor 210. Connector 214 includes body 218 which is composed of back surface 258, first side wall 224, and a top surface 260. Additionally, connector 214 is composed of a second side wall (not shown), a bottom surface (not shown in FIG. 6), and a front surface (not shown in FIG. 6). Back surface 258 includes a cable connector assembly 262 which includes a removable cover 264 which provides access to the apertures and electrical contacts, a pair of attachment points 266 and 268 which anchor cover 264 to connector body 218, and a notch 270 through which a cable (not shown) is fed to electrically connect with connector assembly 212. Side wall 224 includes hinge pin 230 which is inserted in receptacle 248 to rotatably couple connector 214 to extractor 210. The second side wall has a similar hinge pin which is received in a second receptacle 272 located within second member 236 on extractor 210.

Extractor 210 also includes a biasing mechanism 280 which includes a spring 282 and a retaining pin 284 which anchors spring 282 to extractor 210. Spring 282 is positioned between cam arm 240 and connector body 218 and includes a first arm 290 and a second arm 292. First arm 290 extends from spring 282 and contacts connector body 218 and second arm 292 extends from spring 282 and contacts cam arm 240. Spring 282 is positioned such that second arm 292 biases cam arm 240 to remain in first position 252 and further positioned, such that, when cam arm 240 is rotated upwardly clockwise, spring 282 will compress and will return cam arm 240 to position 252 when cam arm 240 is physically released.

The above described extractor for separating a connector assembly from an electrical device is reliable, easily installed, and easily operated. The extractor can be integrally constructed with a connector assembly or can be easily installed on a current connector assembly, and permits the connector assembly to be easily separated from such an electrical device without requiring the great amount of force that must be exerted with known connector assemblies.

While the invention has been described in terms of various specific embodiments, those skilled in the art will recognize that the invention can be practiced with modification within the spirit and scope of the claims.

What is claimed is:

1. A method for removing a cable connector assembly from an electrical device, the connector assembly including a cable connector and an extractor including a body including a cam arm and a cam stop extending outwardly from the body and a biasing mechanism, said method comprising:

rotating the cam arm from a first cam arm position to a second cam arm position;

separating the cable connector assembly from the electrical device such that the cam arm is rotatable from the second cam arm position to the first cam arm position;

removing the cable connector assembly from the electrical device; and limiting over-rotational travel of the cam arm from the second cam arm position to the first cam arm position with the cam stop.

2. A method for removing a cable connector assembly from an electrical device in accordance with claim 1 wherein moving the cam arm from the first cam arm position to the second cam arm position further comprises rotating the cam arm such that a portion of the cam arm engages the electrical device.

3. A method for removing a cable connector assembly from an electrical device in accordance with claim 1 wherein the biasing mechanism is a spring configured to bias the cam arm in the first cam arm position, moving the cam arm from the first cam arm position to the second cam arm position further comprises compressing the spring from a first spring position to a second spring position.

4. A connector assembly for exchanging a signal from a cable to a mating connector mounted on an electrical device, said connector assembly comprising:

a connector; and an extractor movably coupled to said connector, said extractor comprising a body comprising:

at least one portion extending to engage the electrical device for forcibly separating said connector from said electrical device;

a biasing mechanism attached to said extractor body; and a cam stop comprising a first side and an opposite second side, said cam stop extending outwardly from said extractor body such that only said cam stop first side is configured to contact the electrical device.

5. A connector assembly in accordance with claim 4 wherein said extractor is movable with respect to said connector between a first position and a second position.

6. A connector assembly in accordance with claim 5 wherein said biasing mechanism is configured to maintain said extractor in said first position relative to said connector.

7. A connector assembly in accordance with claim 5 wherein said extractor further comprises a cam arm attached to said extractor body, said cam arm configured to move said extractor between said first position and said second position.

8. A connector assembly in accordance with claim 7 wherein said biasing mechanism is a spring positioned between said connector body and said cam arm.

9. A connector assembly in accordance with claim 8 wherein said cam arm is biased to maintain said extractor in said first position relative to said connector.

10. A connector assembly in accordance with claim 6 wherein said biasing mechanism is a spring.

11. A connector assembly in accordance with claim 10 wherein said extractor further comprises a first member extending substantially perpendicular from said extractor body.

12. A connector assembly in accordance with claim 11 wherein said extractor further comprises a second member extending substantially perpendicular from said extractor body, said second member substantially parallel to said first member.

13. An extractor for uncoupling a cable connector assembly from an electrical device, said extractor comprising:

a body movably coupled to said cable connector assembly, said body comprising at least one portion extending to engage the electrical device for forcibly uncoupling the cable connector assembly from the electrical device, and a cam stop extending outwardly from said body for limiting over-rotational travel of said body; and a biasing mechanism coupled between said body and said cable connector assembly.

14. An extractor in accordance with claim 13 wherein said extractor is movable relative to said cable connector assembly between a first position and a second position.

15. An extractor in accordance with claim 14 wherein said biasing mechanism is configured to maintain said extractor in said first position relative to said cable connector assembly.

16. An extractor in accordance with claim 15 wherein said biasing mechanism is a spring.

17. An extractor in accordance with claim 15 wherein said biasing mechanism comprises a pin and a spring, said pin configured to secure said spring to said body, said spring positioned between said body and said cam arm.

18. An extractor in accordance with claim 14 wherein said extractor further comprises a cam arm attached to said body, said cam arm configured to move said extractor between said first position and said second position.

19. An extractor in accordance with claim 18 wherein said cam arm is biased to maintain said extractor in said first position relative to said cable connector assembly.

* * * * *